US012691495B2

(12) United States Patent
Schmitt et al.

(10) Patent No.: US 12,691,495 B2
(45) Date of Patent: Jul. 28, 2026

(54) SINTERED PART AND METHOD FOR PRODUCING SAME

(71) Applicant: GKN Sinter Metals Engineering GmbH, Radevormwald (DE)

(72) Inventors: Rainer Schmitt, Wachtberg (DE); Christian Siegert, Ahrweiler (DE); Maurits van de Velde, Bornheim (DE); Stefan Tiller, Sankt Augustin (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 363 days.

(21) Appl. No.: 17/784,412

(22) PCT Filed: Dec. 11, 2020

(86) PCT No.: PCT/EP2020/085732
§ 371 (c)(1),
(2) Date: Jun. 10, 2022

(87) PCT Pub. No.: WO2021/116391
PCT Pub. Date: Jun. 17, 2021

(65) Prior Publication Data

US 2023/0026312 A1 Jan. 26, 2023

(30) Foreign Application Priority Data

Dec. 12, 2019 (DE) ..... 10 2019 134 153.1

(51) Int. Cl.
*B22F 5/00* (2006.01)
*B22F 3/16* (2006.01)
*B22F 3/24* (2006.01)

(52) U.S. Cl.
CPC ..... *B22F 5/00* (2013.01); *B22F 3/164* (2013.01); *B22F 3/24* (2013.01); *B22F 2003/166* (2013.01)

(58) Field of Classification Search
CPC ..... B22F 3/164; B22F 5/00
See application file for complete search history.

(56) References Cited

U.S. PATENT DOCUMENTS 5,363,006 A * 11/1994 Yano ..... H02N 2/0065 310/323.11
6,101,713 A 8/2000 May et al.
(Continued)

FOREIGN PATENT DOCUMENTS

CN 102029392 A 1/2011
CN 114082957 A * 2/2022 ..... B22F 3/164
(Continued)

OTHER PUBLICATIONS

German Patent and Trademark Office, Examination Report, Application No. 102019134153.1, Sep. 10, 2020, 7 pages [No English Language Translation Available].
(Continued)

*Primary Examiner* — Sally A Merkling
*Assistant Examiner* — Austin Pollock
(74) *Attorney, Agent, or Firm* — Quarles & Brady LLP

(57) ABSTRACT

A sintered part has at least one base with a first end face which faces in a first axial direction and a second end face which faces in a second axial direction. The end faces are produced in a press for producing a green body (which is subsequently sintered to form the sintered part) by applying at least one punch which can be moved along the axial directions. The sintered part has an elevation extending from the first end face towards one end at least in the axial direction over a first height, and the elevation has a first width extending transversely to the axial direction in a radial direction and at least some portions of which are smaller than 0.8 millimeters, wherein at least some portions of the
(Continued)

Figure 1:
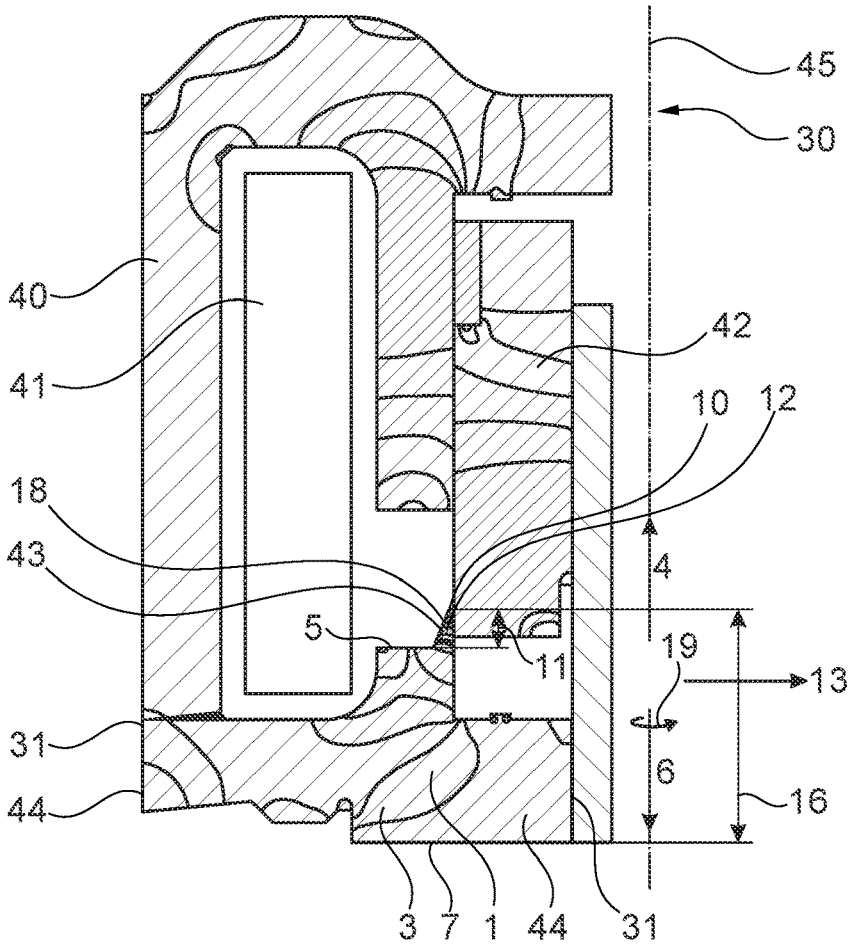

sintered part have a first density along the first width, said density equaling at least 87% of the full material density.

13 Claims, 3 Drawing Sheets

(56) References Cited

U.S. PATENT DOCUMENTS

| | | | | |
|---|---|---|---|---|
| 6,139,975 | A | 10/2000 | Mawatari et al. | |
| 9,718,120 | B2 | 8/2017 | Kruzhanov et al. | |
| 10,022,798 | B2 | 7/2018 | Weiermair et al. | |
| 11,148,187 | B2 | 10/2021 | Hirayama et al. | |
| 2007/0212248 | A1* | 9/2007 | Nii | B22F 3/24 419/28 |
| 2008/0197719 | A1 | 8/2008 | Nakagawa et al. | |
| 2010/0178190 | A1* | 7/2010 | Colombo | F04C 2/084 418/161 |
| 2011/0076175 | A1 | 3/2011 | Tokoi et al. | |
| 2011/0132057 | A1* | 6/2011 | Schmid | B22F 3/164 72/352 |
| 2018/0308613 | A1 | 10/2018 | Ishida et al. | |
| 2019/0262891 | A1* | 8/2019 | Hirayama | B21K 1/30 |
| 2022/0152701 | A1* | 5/2022 | Ishimine | C22C 38/00 |

FOREIGN PATENT DOCUMENTS

| | | | | |
|---|---|---|---|---|
| DE | 4417663 | A1 | 11/1995 | |
| DE | 102011011886 | A1 * | 8/2012 | B22F 3/164 |
| DE | 102012017040 | A1 | 3/2014 | |
| DE | 102006041584 | B4 | 10/2015 | |
| DE | 102015211657 | B3 | 6/2016 | |
| DE | 102016200341 | A1 | 7/2016 | |
| EP | 2930727 | A1 | 10/2015 | |
| EP | 2978000 | A1 | 1/2016 | |
| JP | S5741303 | A | 3/1982 | |
| JP | H07112231 | A | 5/1995 | |
| JP | H1121602 | A | 1/1999 | |
| JP | 2003250256 | A | 9/2003 | |
| JP | 2006114625 | A | 4/2006 | |
| JP | 2009113103 | A | 5/2009 | |
| JP | 2010053970 | A | 3/2010 | |
| JP | 2012204574 | A | 10/2012 | |
| JP | 2012216679 | A | 11/2012 | |
| JP | 2019143750 | A | 8/2019 | |
| WO | WO-2010141792 | A1 * | 12/2010 | H04L 65/1016 |
| WO | WO-2011122558 | A1 * | 10/2011 | B22F 3/10 |
| WO | 2016020234 | A1 | 2/2016 | |

OTHER PUBLICATIONS

Japan Patent Office, Notice of Reasons for Refusal and Search Report, Application No. 2022-535467, Jul. 11, 2023, 44 pages.

PCT International Search Report and Written Opinion and translation thereof, PCT/EP2020/085732, Feb. 22, 2021, 23 pages.

National Intellectual Property Administration of People's Republic of China, First Office Action and Search Report, Application No. 202080096554.X, Jun. 5, 2024, 12 pages.

Dong, Die-Casting Molds: Forging Molds and Other Molds, Oct. 31, 1998, 209-213 [No English Translation Available].

Chinese National Intellectual Property Administration, Decision on Rejection, Application No. 202080096554.X, Aug. 27, 2025, 14 pages.

The State Intellectual Property Office of People's Republic of China, Fourth Office Action and Search Report, Application No. 202080096554.X, Jun. 26, 2025, 13 pages [English Translation of Search Report Only].

Lina et al., Effect of CuCr Contact Material on Vacuum Small Gap Breakdown Strength at High Temperature, Transactions of the Chinese Society of Electrotechnical Engineering, Jun. 26, 1998, 13(3):37-40, 50.

The State Intellectual Property Office of People's Republic of China, Third Office Action and Search Report, Application No. 202080096554.X, Mar. 3, 2025, 27 pages.

* cited by examiner

SINTERED PART AND METHOD FOR PRODUCING SAME

This application represents the U.S. national stage entry of International Application No. PCT/EP2020/085732 filed Dec. 11, 2020, which claims priority to German Patent Application No. 10 2019 134 153.1 filed Dec. 12, 2019, the disclosure of which is incorporated herein by reference in its entirety and for all purposes.

Sintered parts of this type can be reworked by a follow-up pressing operation, what is referred to as calibration, in order to obtain a greater degree of dimensional accuracy or an at least locally higher density. The calibration is usually done by subjecting the sintered part to a first compressive force, which is caused to act on the sintered part in an axial direction by a calibrating tool.

Sintered parts of this type can also be reworked, i.e. shaped or further compacted, by a rolling process (also referred to as rolling). In the rolling process, the sintered part is subjected to a second compressive force acting in the radial direction.

The calibration and rolling are generally carried out one after the other in time in tools that are independent of one another. The sintered part must first be arranged and processed in the first tool (calibrating tool or rolling tool). The processed sintered part is then removed from the first tool and arranged in the second tool (rolling tool or calibrating tool).

DE 10 2015 211 657 B3 and DE 10 2006 041 584 B4 disclose, among other things, methods for producing components wherein the components are sintered parts which, after calibration, are processed by a rolling process.

Certain geometries can be produced with difficulty or not at all as sintered parts for which certain properties, such as e.g. density, are predefined. It is precisely thin-walled geometries, possibly with opposite side surfaces running at an angle to one another, that can be produced only with lower density.

It is an object of the present invention to at least partially solve the problems mentioned in relation to the prior art. In particular, the intention is to propose a calibrated sintered part which has certain geometries and yet has an at least locally high density.

A method having the features of claim 1 contributes to achieving these objects. The dependent claims relate to advantageous embodiments. The features set out individually in the claims may be combined with one another in any technologically meaningful way and may be supplemented by explanatory substantive matter from the description and/or details from the figures, with further embodiment variants of the invention being shown.

A (calibrated) sintered part of a metallic material is proposed. The sintered part is produced by pressing a powdered metallic material to form a green compact and by subsequent sintering. The sintered part has at least one base with a first end face facing in a first axial direction and a second end face facing in a second axial direction, which are produced in a press for producing the green compact by applying at least one punch that can be moved in the axial directions. The sintered part has an elevation extending over a first height from the first end face to one end at least in the axial direction. The elevation has a first width extending in a radial direction and transversely to the axial direction that is (greater than 0 mm and) at least partially less than 0.8 millimeters. Along the first width, the sintered part at least partially has a first density which is at least 85% of a full density of the material.

The sintered part is produced in particular from a powdered material by pressing to form a green compact and subsequently by sintering to form a solid workpiece (the sintered part). After the sintering, the sintered part is in particular calibrated to form a calibrated sintered part. The calibration comprises in particular a follow-up pressing of the sintered part in order to obtain a greater degree of dimensional accuracy or an at least locally higher density. In the following text, the term sintered part refers in particular to a calibrated sintered part, i.e. to a component that is mechanically processed (i.e. at least subsequently pressed or further compacted) after the sintering.

In particular, the powdered material used for the production of the green compact at least partially comprises a metallic material, in particular a magnetic material, i.e. a soft-magnetic or hard-magnetic material. Furthermore, in particular a binder used to bond the metallic material to form the green compact is provided. In preparation for the sintering process, the binder is first removed from the metallic material. During the sintering, the green compact or the binder-free brown compact is subjected to a temperature that is only slightly below a melting temperature of the metallic material, with the result that the metallic particles bond to one another by way of the formation of sintering necks and a sintered part with a settable density is created.

In particular, the sintered part is produced by a follow-up pressing operation, what is referred to as calibration, after the sintering, which is used to obtain a greater degree of dimensional accuracy or an at least locally higher density.

The base of the sintered part comprises e.g. a disk-shaped part of the sintered part, from which the elevation extends in the axial direction.

The position in which the green compact was produced in a press is in particular discernible on the sintered part, e.g. on the microstructure of the surfaces, or else already on the geometry of the sintered part. In particular, punches that can be moved in the axial direction are applied to the end faces. The powdered material is arranged in the press, e.g. in a receptacle formed by a lower punch and a die. If necessary, partial regions of the peripheral surface of a green compact can be compacted by slides or punches that can be displaced in a radial direction.

In particular, the first density along the first width is at least partially at least 92%, preferably at least 94%, particularly preferably at least 97%, of the full density of the material.

In particular, the first width is at least partially less than 0.5 millimeters, preferably less than 0.3 millimeters. In particular, the first width is at least 0.1 or at least 0.15 millimeters.

In particular, the first density along a first width of less than 0.5 millimeters is at least partially at least 89%, preferably at least 92%, particularly preferably at least 94%, of the full density of the material.

In particular, the first density along a first width of less than 0.3 millimeters is at least partially at least 87%, preferably at least 89%, particularly preferably at least 92%, of the full density of the material.

In particular, the sintered part has a second height that extends in the axial direction between the second end face and the end. In the axial direction between the first end face and the end, the elevation has a maximum second width extending in the radial direction, wherein the second width is at most 5.0 millimeters, in particular at most 1.0 millimeter, preferably at most 0.8 millimeters, wherein the first height is at least 5%, in particular at least 15%, preferably at least 20%, particularly preferably at least 30%, of the second height.

The second height is determined from the end to that part of the second end face that is arranged opposite the end in the axial direction. Therefore, the second height is in particular not the greatest extent of the sintered part in the axial direction.

In particular, the elevation has at least the respective specified first density over the entire first width. In particular, the entire elevation has at least the respective specified first density.

In particular, at least one side surface of the elevation runs at least partially inclined at an angle of at most 30 angular degrees, in particular at most 20 angular degrees, preferably at most 15 angular degrees, particularly preferably at most 10 angular degrees, with respect to the axial direction.

In particular, the elevation extends transversely to the radial direction and transversely to the axial direction, i.e. e.g. in a peripheral direction. In particular, the elevation has a further side surface which is opposite the side surface, each of which extends from the first end face to the end and in the direction extending transversely to the radial direction and transversely to the axial direction, i.e. e.g. in a peripheral direction.

In particular, at least one side surface of the elevation runs at least partially inclined at an angle of at most 30 angular degrees, in particular at most 20 angular degrees, preferably at most 15 angular degrees, particularly preferably at most 10 angular degrees, with respect to the opposite, further side surface.

In particular, the elevation extends in a peripheral direction, extending transversely to the axial direction (and transversely to the radial direction), along the first end face in the form of a ring or of a segment of a ring. The extent in the form of a ring forms in particular an elevation around the full periphery, whereas the extent in the form of a segment of a ring comprises only at least a partial region of an extent in the form of a ring.

In particular, at least the elevation has multiple regions with differing densities in a cross section. In particular, the densities of different regions differ by at least 1 percentage point, preferably by at least 2 percentage points, particularly preferably by at least 3 percentage points.

If the density in a first region is e.g. 86% and in a second region is 87% of the full density of the material, the densities of the two regions differ by 1 percentage point.

In particular, at least after the sintering, the end is processed exclusively by shaping or further compacting. In particular, at least after the sintering, the end has not undergone a machining or material removing treatment. Such machining can be identified e.g. by means of the surface of the end. The sintered part has a third end face that extends parallel to the radial direction.

In particular, at least the elevation consists at least partially, preferably completely, of a magnetic material, e.g. of a soft-magnetic or hard-magnetic material. In particular, the sintered part consists completely of a magnetic material.

A method for producing the (calibrated) sintered part described is proposed. The method comprises at least the following steps:

a) providing a sintered part, wherein the sintered part has at least one base with a first end face facing in a first axial direction and a second end face facing in a second axial direction and also an elevation extending over a first height from the first end face to one end at least in the axial direction, wherein the elevation forms a third end face at the end;

b) arranging the sintered part in a tool, e.g. in a receptacle of the tool;

c) using the tool to subject the sintered part to a first compressive force acting on the end faces, in particular the first end face, the second end face and the third end face, at least in the axial direction;

d) subjecting the sintered part to a second compressive force acting at least on part of the elevation at least in a radial direction, wherein the sintered part is shaped at least by the second compressive force, wherein steps c) and d) are carried out at least partially at the same time and the sintered part is a calibrated sintered part (1) after steps c) and d).

The above (non-conclusive) subdivision of the method steps into a) to d) is intended to serve primarily only for distinguishing purposes and not to dictate any sequence and/or dependency. The frequency of the method steps may also vary. Equally, it is possible for method steps to at least partially overlap in time. Method step d) very particularly preferably takes place during step c). Preferably, at least steps a) to c) are performed in the stated sequence.

In step b), the sintered part is arranged in the tool, e.g. in a receptacle of the tool.

In step c), the tool is used to subject the sintered part to a first compressive force acting on the end faces at least in the axial direction. For this purpose, the tool has in particular at least one, possibly several, punches which can be moved relative to the sintered part in the axial direction and at least partially contact the end faces. In particular, at least one punch is applied to each end face.

In particular, at least part of each end face is subjected to the first compressive force. In particular, at least 50% of an end face is subjected to the first compressive force.

In particular, all of the third end face is subjected to the first compressive force.

The first compressive force caused to act on the sintered part by the respective punch may be different for each punch or may have the same magnitude for each punch.

In step d), the sintered part is subjected to a second compressive force acting on the peripheral surface at least in a radial direction.

The sintered part is shaped and/or further compacted at least by the second compressive force and steps c) and d) are carried out at least partially at the same time. In particular, the sintered part is subjected to the second compressive force only when the sintered part is also subjected to the first compressive force.

In particular, the second compressive force is transmitted to the sintered part via at least one roller of a rolling tool or via a slide that can be displaced in the radial direction.

The first compressive force is used at least to assist the shaping or further compaction brought about by the second compressive force. In particular, the first compressive force does not shape and/or further compact the sintered part.

As an alternative or in addition, the first compressive force at least shapes and/or further compacts the sintered part, at least in the region of one of the three end faces, preferably at least in the region of the third end face.

This further compaction or shaping of a sintered part is referred to as calibration. This makes it possible to obtain e.g. a greater degree of dimensional accuracy of the sintered part or an at least locally higher density.

In particular, the first compressive force is at least 200 megapascals [MPa], preferably at least 500 MPa, particularly preferably at least 1000 MPa.

In particular, the second compressive force is at least 200 megapascals [MPa], preferably at least 500 MPa, particularly preferably at least 1000 MPa.

The combination of the first compressive force and the second compressive force, i.e. in particular subjecting the sintered part to these compressive forces at least partially at the same time, makes it possible in particular to produce certain properties of the sintered part that hitherto at least in part were not able to be realized.

In particular, the elevation has to date only been producible with low densities of less than 85% of the full density of the material, i.e. 100% density, i.e. pore-free.

In particular, the sintered part is also at least partially shaped by the first compressive force.

When calibrating and e.g. rolling processes are carried out in succession, cracks can form due to the high stress gradients in the sintered part. As a result of subjecting the sintered part to the first compressive force and the second compressive force at least partially at the same time, it is possible to reduce these stress gradients in the sintered part.

In particular, the compressive forces acting on certain surfaces (e.g. third end face, side surface and/or peripheral surface) or on all surfaces make it possible to counteract undesired deformation (plastic flow into free spaces) e.g. during rolling, or to controlledly introduce this plastic deformation selectively into defined and precisely reproducible regions of the sintered part.

In particular, this method is applicable in the case of sintered parts with high initial porosity, e.g. a porosity of at least 15%, in particular at least 20%, preferably at least 25%. As a result of the application of compressive forces via the end faces and the side surfaces and/or peripheral surface, large compressive forces make it possible to generate high stresses in the sintered part and thus to obtain a very great degree of shaping and a great degree of compaction, specifically in an elevation (to densities of at least 85%, in particular of at least 87%, preferably at least 89%) combined with a low risk of cracking and very high precision.

Due to the combination of the methods of calibrating and rolling or subjecting the sintered part to the second compressive force via slides, it is possible in particular to considerably shorten the processing of the sintered part. In particular, it is only necessary to clamp the sintered part into a tool once (previously at least twice, once into the calibrating tool and once into the rolling tool).

Consolidating the processing methods (calibrating, rolling or shaping and/or follow-up pressing via the second compressive force) in particular makes it possible to save on a clamping technique for the sintered part that would otherwise be required for the rolling. In the present case, the required clamping force is generated by way of the at least one punch and the first compressive force. This results in particular in greater flexibility in terms of the surfaces of the sintered part that are to be shaped by rolling or by the at least one slide.

In particular, the second compressive force is applied to the sintered part via at least one rolling tool or via a slide that can be moved at least in the radial direction.

In particular, the sintered part is pressed quasi-isostatically by the first compressive force and the second compressive force.

In particular, the first compressive force and the second compressive force thus substantially balance out stress in the sintered part, since forces act on the sintered part both in the axial direction and in the radial direction (depending on the number and size of the regions of the peripheral surface with which contact is made). In particular, the compressive forces are set such that the lowest possible stress gradients are present in the sintered part. In particular, the first compressive force and the second compressive force thus have the same magnitude or at least have the same orders of magnitude (i.e. 100 to 999 MPa, or 1000 to 9999 MPa, etc.).

In particular, the sintered part is also at least partially shaped by the first compressive force. In particular, the sintered part is at least partially further compacted by the first compressive force.

In particular, the at least one slide or the at least one rolling tool also supports the sintered part at least partially with respect to the axial direction (in addition to the support provided by the components of the tool that apply the first compressive force, e.g. the at least one punch). This support may be realized by a shoulder on a roller of the rolling tool. In this case, the sintered part is supported on the shoulder with respect to the axial direction, e.g. by way of the third end face. The shoulder acts on the sintered part with a first compressive force in this respect.

In the case of the above-mentioned small sintered parts, but also in the case of larger sintered parts, the almost comprehensively possible clamping of the sintered part in the tool makes it possible to selectively and highly intensively shape even very small regions of the sintered part. In the process, the high compressive stresses required for this in the regions of the sintered part that adjoin the parts of the peripheral surface with which the rolling tool and/or the slide make contact do not result in cracks in the material of the sintered part or in undesired deformations of the sintered part.

In particular, the following advantages can be obtained with the combined method:

- The geometries that can be produced are expanded by radial features or features on the peripheral surface (peripheral grooves, bevels, chamfers, burring, rounding, low wall thicknesses (at most 0.8 mm [millimeters], geometry/shape changes, angles, etc.).
- The density in the sintered part can also be greatly increased in local regions.
- Increase in strength near the surface as a result of cold work-hardening or cold forming.
- The surface quality can be improved.
- Diameter tolerance can be greatly improved.
- Concentricity tolerances can be improved.
- Production of thin-walled sintered parts with a large length in the axial direction is possible, e.g. ratio of length (first height in this instance) to wall thickness (second width in this instance) of more than 20. In this respect, it is now possible to realize the highest possible and at the same time, if appropriate, homogeneous density in the sintered part.
- Creation of small wall thicknesses (width), which up to now were not able to be produced in the case of green compacts or by calibration alone, e.g. due to the necessary separation processes of the tools during the production of the green compact or during calibration.
- Production of conical portions of the sintered part, in particular with angles of less than 60 angular degrees with respect to the axial direction.
- Production of radial formations and/or undercuts and also peripheral grooves on the sintered part.
- Creation of locally modified densities in the sintered part by way of the second compressive force.

Creation of a density of at least 85% in thin-walled regions e.g. elevations.

In particular, the first compressive force is applied to the sintered part over at least 75%, preferably over at least 90%, particularly preferably over at least 95% of the first end face and/or second end face and/or the third end face. In particular, the first compressive force is applied to the sintered part over the entire first end face and/or the entire second end face and/or the entire third end face.

In particular, the second compressive force is applied to the sintered part by way of at least one rolling tool or at least one slide. The at least one rolling tool is in particular a constituent part of the tool. By means of the at least one rolling tool or the at least one slide, the sintered part arranged in the receptacle of the tool and at least fixed by the first compressive force can be processed on its peripheral surface, in particular on a side surface of the elevation, if necessary in particular on its entire peripheral surface.

A rolling tool comprises in particular a roller which is guided at least or exclusively in a peripheral direction along the peripheral surface of the sintered part. The second compressive force is applied to the sintered part via the roller. In particular, the roller rolls on the sintered part in the process. The outer peripheral surface of the rolling tool may have a specific shape, with the result that this specific shape is transferred to the sintered part via the rolling tool in the course of the rolling operation.

In particular, a plurality of rolling tools are arranged in the tool in a peripheral direction, with the second compressive force being applied to the sintered part at least intermittently at the same time by multiple rolling tools.

A slide is in particular moved up to the sintered part only in the radial direction. The second compressive force is transmitted to the sintered part via the slide. The pressing surface of the slide that makes contact with the sintered part may have a specific shape, with the result that this specific shape is transferred to the sintered part via the slide in the course of the follow-up pressing operation/compacting operation.

A tool for producing a (calibrated) sintered part by the method described is also proposed. The sintered part has at least one base with a first end face facing in a first axial direction and a second end face facing in a second axial direction, which are produced in a press for producing the green compact by applying at least one punch that can be moved in the axial directions. The sintered part has an elevation extending over a first height from the first end face to one end at least in the axial direction. The tool comprises at least

- a receptacle, in which the sintered part can be arranged for further processing,
- a punch for subjecting the sintered part arranged in the receptacle to the first compressive force, and
- at least one rolling tool or slide for subjecting the sintered part arranged in the receptacle to the second compressive force.

In particular, the tool comprises at least one control unit suitably designed (equipped, configured or programmed) to control the tool for carrying out the method, with the control unit being able to control the first compressive force and additionally the second compressive force at least intermittently at the same time.

In particular, at least one punch, which can be moved in the axial direction with respect to the sintered part, is provided on each side of the sintered part.

In particular, the at least one rolling tool or the slide is arranged in a radial direction next to the receptacle for the sintered part.

In particular, the rolling tool rotates around the sintered part in the peripheral direction, or the sintered part is rotated (in particular together with the punches).

The use of the sintered part described or of the sintered part produced (calibrated) by the method described for a device utilizing magnetic forces is also proposed. An elevation of the sintered part consists at least partially of a magnetic material, with the elevation being employed to influence a magnetic flux density.

The device may comprise e.g. an actuator, in which a body of the device is displaceable with respect to a housing of the device in an axial direction for the purpose of actuating a component. The displacement of the body can be achieved by subjecting the body to a magnetic field, it being possible to generate the magnetic field e.g. by means of a coil which is exposed to an electric current. The elevation makes it possible to improve a magnetic flux density, with the result that, with a component produced by sintering technology, the actuator can be actuated in the same effective way as previously was achieved only with solid materials that were machined.

The statements relating to the sintered part apply in particular in the same way to the method, the tool and the use, and vice versa.

The use of indefinite articles ("a" and "an"), in particular in the claims and the description reflecting them, should be understood as such and not as a numerical term. Correspondingly introduced terms or components are to be understood such that they are present at least once but in particular can also be present multiple times.

It is pointed out by way of precaution that the numerical terms used here ("first", "second", etc.) serve primarily (only) for distinction between multiple similar objects, dimensions or processes, that is to say in particular do not imperatively specify any dependency and/or sequence of these objects, dimensions or processes in relation to one another. Should a dependency and/or sequence be necessary, this is explicitly stated here, or is obvious to a person skilled in the art when studying the specifically described embodiment. If a component can occur more than once ("at least one"), the description relating to one of these components can similarly apply to all or some of the plurality of these components, but this is not mandatory.

Figure 2:
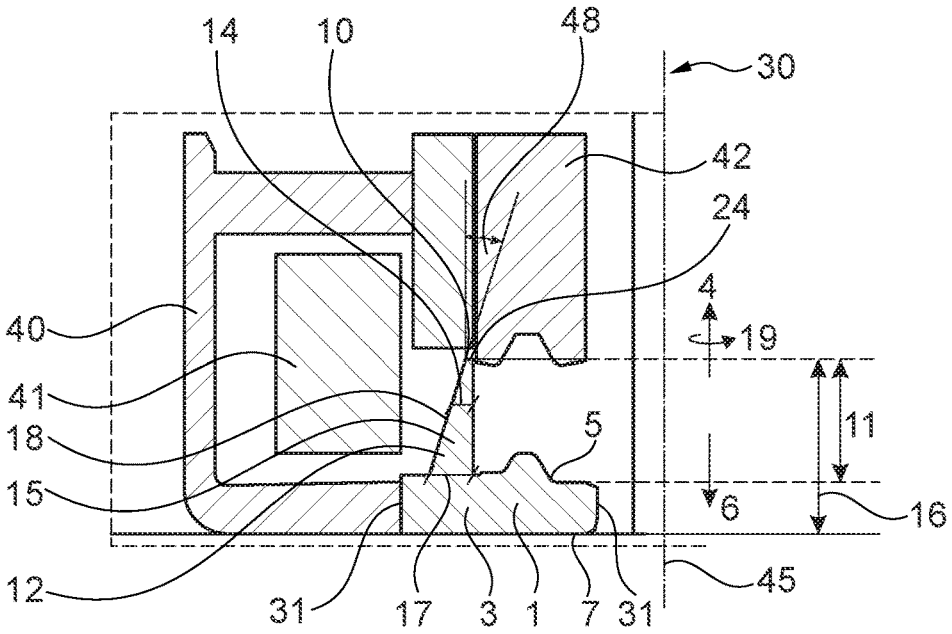
Figure 3:
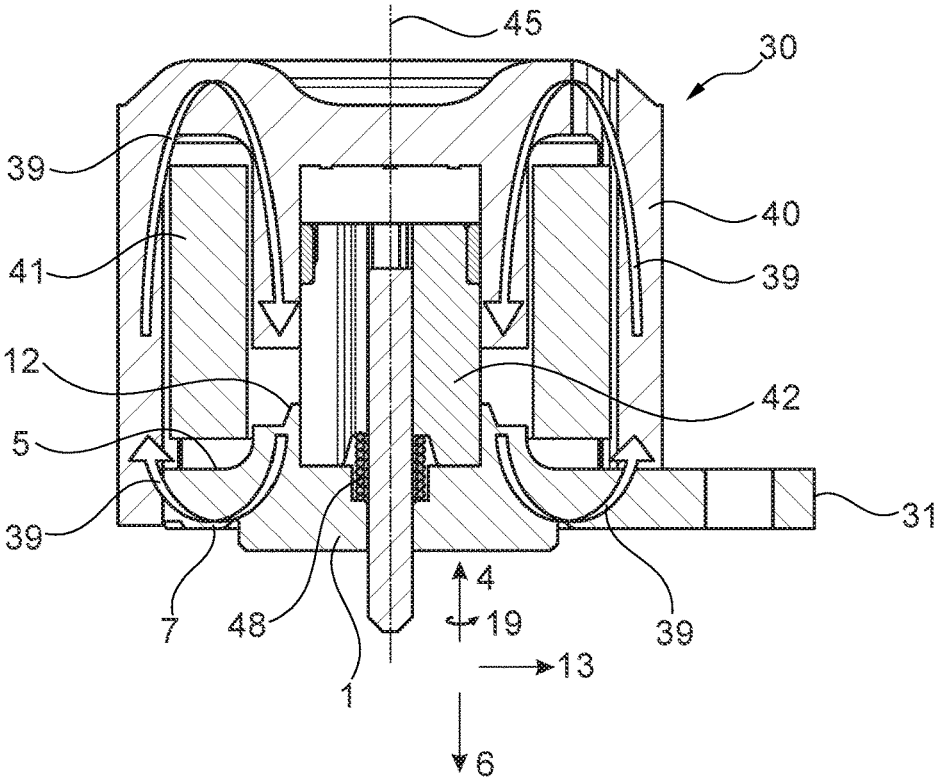
Figure 4:
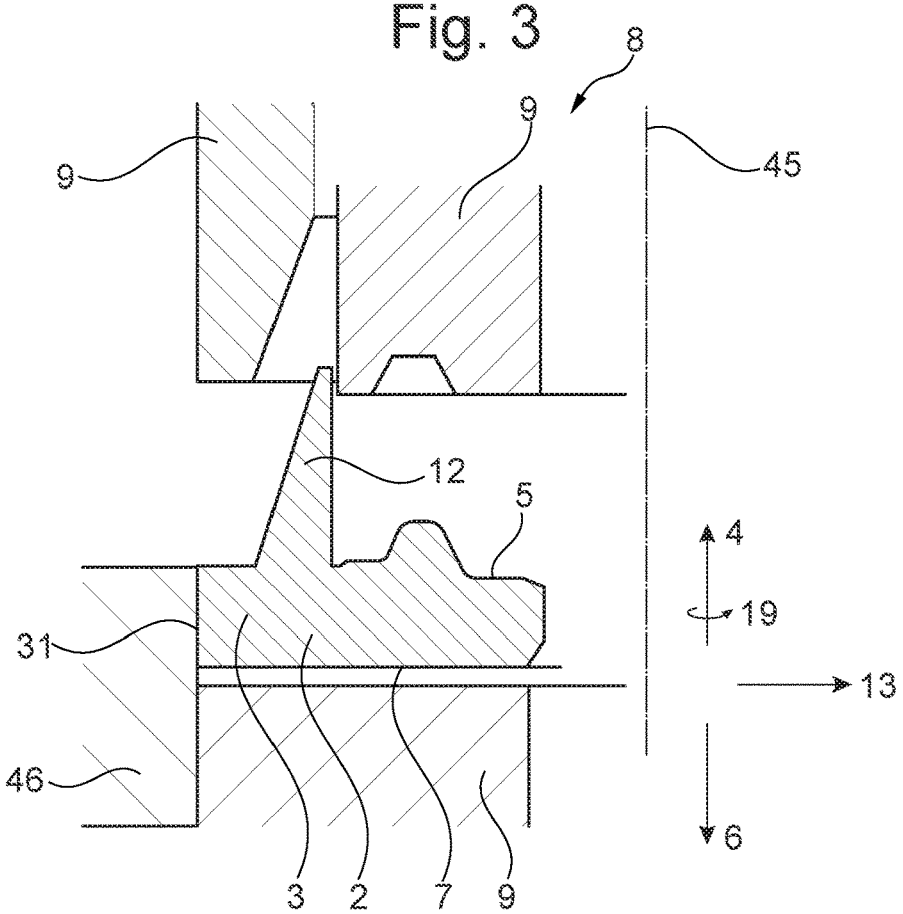
Figure 5:
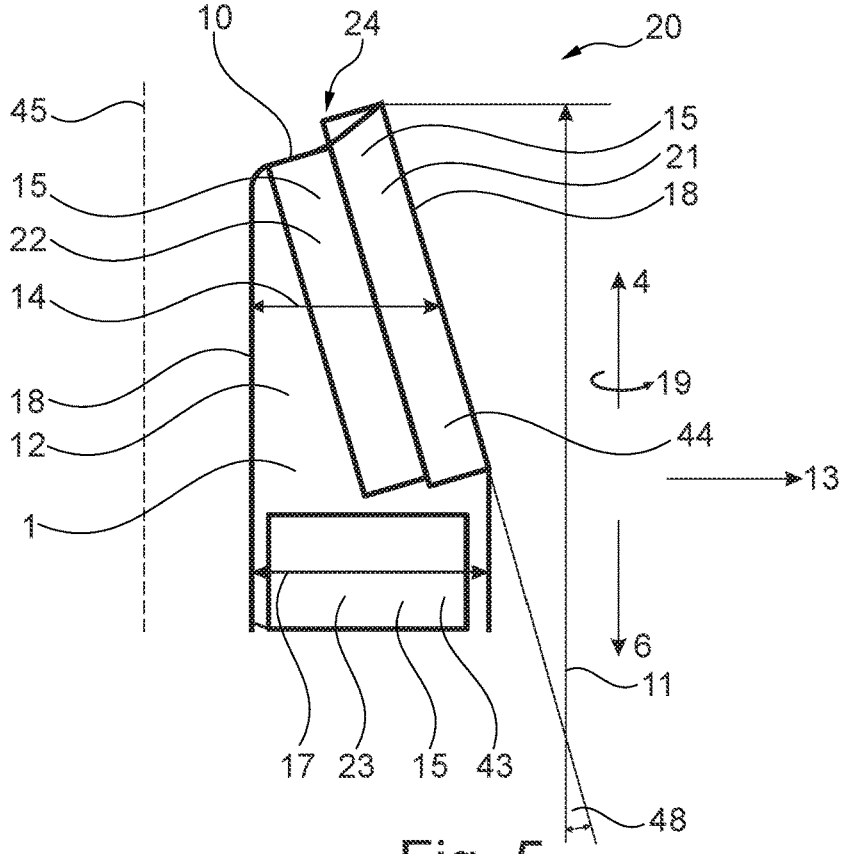
Figure 6:
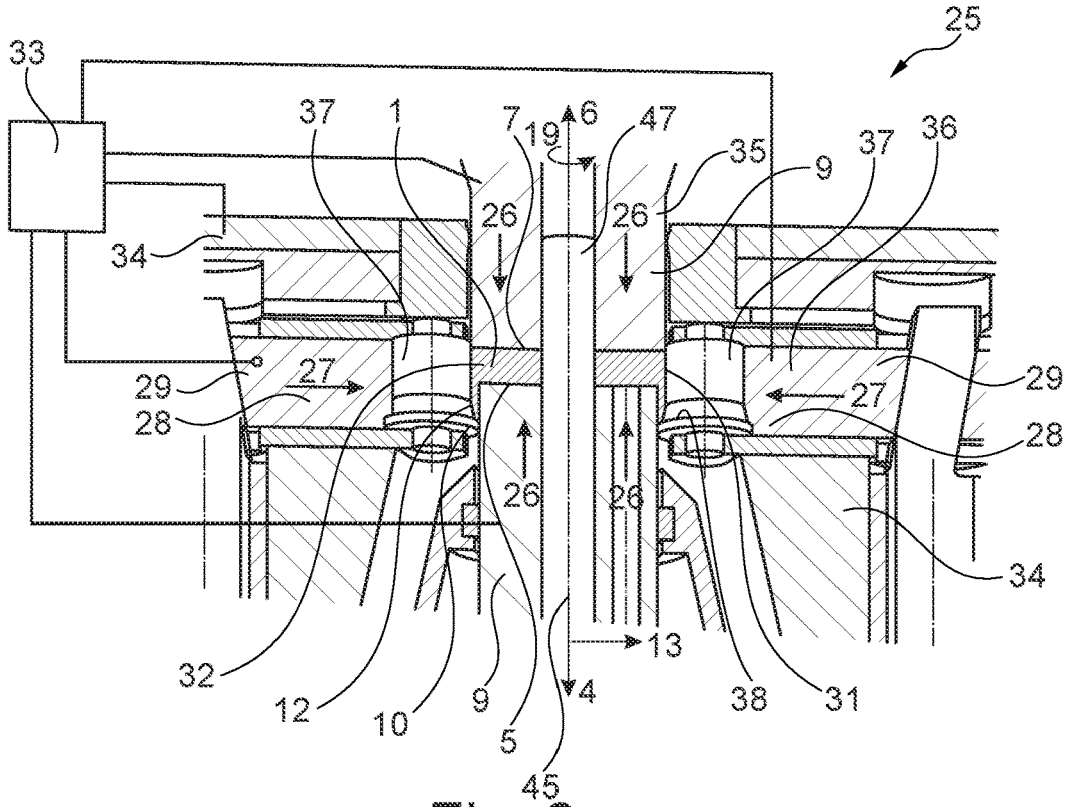

The invention and the technical field will be explained in more detail below on the basis of the appended figures. It is to be noted that the invention is not intended to be limited by the exemplary embodiment variants mentioned. In particular, unless explicitly stated otherwise, it is also possible to extract partial aspects of the explanatory substantive matter illustrated in the figures and to combine these with other constituent parts and findings from the present description. In particular, it is to be noted that the figures and in particular the size ratios illustrated are only schematic. In the figures:

FIG. 1: shows a side view in section of a part of a first embodiment variant of a device utilizing magnetic forces;

FIG. 2: shows a side view in section of a part of a second embodiment variant of a device utilizing magnetic forces;

FIG. 3: shows a side view in section of a third embodiment variant of a device utilizing magnetic forces;

FIG. 4: shows a side view in section of a press and a green compact;

FIG. 5: shows a side view in section of an elevation of a sintered part; and FIG. 6: shows a perspective view in section of a tool.

FIG. 1 shows a side view in section of a part of a first embodiment variant of a device 30 utilizing magnetic forces. The device 30 is an actuator, in which a body 42 of the device 30 is displaceable with respect to a housing 40 of the device 30 in an axial direction 4, 6 and along the axis 45 for the purpose of actuating a component. The device 30 is substantially rotationally symmetrical in relation to the axis 45. The displacement of the body 42 can be achieved by subjecting the body 42 to a magnetic field, it being possible to generate the magnetic field e.g. by means of a coil 41 which is exposed to an electric current.

The housing 40 comprises a sintered part 1 of a metallic material. The sintered part 1 is produced by pressing a powdered metallic material to form a green compact 2 (see FIG. 4) and by subsequent sintering. The sintered part 1 has a base 3 with a first end face 5 facing in a first axial direction 4 and a second end face 7 facing in a second axial direction 6, which are produced in a press 8 (see FIG. 4) for producing the green compact 2 by applying at least one punch 9 (see FIG. 4) that can be moved in the axial directions 4, 6. The sintered part 1 has an elevation 12 extending over a first height 11 from the first end face 5 to one end 10 at least in the axial direction 4, 6.

In FIG. 1, the housing 40, the body 42 and the sintered part 1 are components produced conventionally by sintering technology. This figure illustrates regions of different densities, in particular regions with a greatest density 44 and areas with a lowest density 43. On account of the special geometry of the elevation 12, this region has a lowest density 43.

FIG. 2 shows a side view in section of a part of a second embodiment variant of a device 30 utilizing magnetic forces. FIG. 3 shows a side view in section of a third embodiment variant of a device 30 utilizing magnetic forces. FIGS. 2 and 3 will be described jointly below. Reference is made to the statements relating to FIG. 1.

The sintered part 1 has a base 3 with a first end face 5 facing in a first axial direction 4 and a second end face 7 facing in a second axial direction 6, which are produced in a press 8 (see FIG. 4) for producing the green compact 2 by applying at least one punch 9 (see FIG. 4) that can be moved in the axial directions 4, 6. The sintered part 1 has an elevation 12 extending over a first height 11 from the first end face 5 to one end 10 at least in the axial direction 4, 6.

The elevation 12 has a first width 14 extending in a radial direction 13 and transversely to the axial direction 4, 6. Along the first width 14, the sintered part 1 at least partially has a first density 15.

The sintered part 1 is produced by a follow-up pressing operation, what is referred to as calibration, after the sintering, which is used to obtain a greater degree of dimensional accuracy or an at least locally higher density.

The base 3 of the sintered part 1 comprises a disk-shaped part of the sintered part 1, from which the elevation 12 extends in the axial direction 4, 6.

The sintered part 1 has a second height 16 that extends in the axial direction 4, 6 between the second end face 7 and the end 10. In the axial direction 4, 6 between the first end face 5 and the end 10, the elevation 12 has a maximum second width 17 extending in the radial direction 13.

A side surface 18 of the elevation 12 runs inclined at an angle 48 with respect to the axial direction 4, 6.

The elevation 12 extends transversely to the radial direction 13 and transversely to the axial direction 4, 6 in a peripheral direction 19. The elevation 12 has a further side surface which is opposite to the side surface 18, each of which extends from the first end face 5 to the end 10 and in the peripheral direction 19 extending transversely to the radial direction 13 and transversely to the axial direction 4, 6.

The elevation 12 extends in the form of a ring in the peripheral direction 19 along the first end face 5. The extent 12 in the form of a ring forms an elevation 12 around the full periphery.

The device 30 is an actuator, in which a body 42 of the device 30 is displaceable with respect to a housing 40 of the device 30 in an axial direction 4, 6 and along the axis 45 for the purpose of actuating a component. The device 30 is substantially rotationally symmetrical in relation to the axis 45. The displacement of the body 42 can be achieved by subjecting the body 42 to a magnetic field, it being possible to generate the magnetic field e.g. by means of a coil 41 which is exposed to an electric current. When the electric current is switched off, the body 42 is displaced back in the first axial direction 4 via the spring 48.

The elevation 12 makes it possible to improve the magnetic flux density. The conical shape of the elevation 12 toward the end 10 enables the field lines 39 of the magnetic field to be effectively coupled into the body 42.

FIG. 4 shows a side view in section of a press 8 and a green compact 2. Reference is made to the statements relating to FIGS. 1 to 3.

The sintered part 1 illustrated in FIGS. 1 to 3 and 5 is produced from a powdered material by pressing to form a green compact 2 and subsequently by sintering to form a solid workpiece (the sintered part 1).

Punches 9 that can be moved in the axial direction 4, 6 are applied to the end faces 5, 7. The powdered material is arranged in the press 8, in this instance in a receptacle 32, formed by a lower punch 9 and a die 46, of the press 8. In this respect, it is precisely in the region of the elevation 12 that only a low density can be obtained.

This region of the elevation 12 is further compacted and further shaped in particular during calibration in a calibrating tool 25.

FIG. 5 shows a side view in section of an elevation 12 of a sintered part 1 (e.g. a sintered part according to FIGS. 2 and 3). Reference is made to the statements relating to FIGS. 1 to 4.

The sintered part 1 has an elevation 12 extending over a first height 11 from the first end face 5 to one end 10 at least in the axial direction 4, 6. The elevation 12 has a first width 14 extending in a radial direction 13 and transversely to the axial direction 4, 6. Along the first width 14 and along the first height 11, the sintered part 1 has a first density 15. The elevation 12 has multiple regions 21, 22, 23 with differing first densities 15 in the cross section 20. The first region 21 has the highest density 44 of the first densities 15. The third region 23 has the lowest density 43 of the first densities 15. The first density 15 of the second region 22 lies between the values of the highest density 44 and the lowest density 43.

A selective further compaction of the sintered part 1 can also be used to locally set a density, with the result that high and possibly different densities can be provided. A density setting or density distribution of this kind in a sintered part 1 of magnetic material can be especially advantageous specifically for devices 30 utilizing magnetic forces.

It can be seen in FIG. 5 that the end 10 was shaped as a result of the further compaction of the side surface 18 and a projection extending in the axial direction 4, 6 has formed in the process. A deformation of this kind can be prevented by using a first compressive force 26 to support specifically the third end face 24 with respect to the axial direction 4, 6 (see FIG. 6). By subjecting the sintered part 1 to a first compressive force 26 and a second compressive force 27 at the same time, it is possible on the one hand to achieve further compaction and on the other hand to realize a predetermined geometry of the further-compacted sintered part.

FIG. 6 shows a side view in section of a tool 25. Reference is made to the statements relating to FIGS. 1 to 5.

The tool 25 comprises a receptacle 32, in which the sintered part 1 is arranged for further processing. The tool 25 also comprises an upper punching unit having a punch 9 above the receptacle 32 and a lower punching unit having punches 9 below the receptacle 32 for the purpose of subjecting the sintered part 1 arranged in the receptacle 32 to the first compressive force 26. The lower punching unit has a mandrel 47 which extends through the sintered part 1 and into the punch 9 of the upper punching unit. In this instance, the receptacle 32 is formed by way of the punching units or the punches 9 and the mandrel 47. Furthermore, two rolling tools 28, consisting of a roller 37 and a roller carrier 36, are provided for subjecting the sintered part 1 arranged in the receptacle 32 to the second compressive force 27.

Instead of the rolling tools 28, it is also possible to provide slides 29 (only indicated here), which are advanced with respect to the sintered part 1 only in the radial direction 13.

The rolling tools 28 are arranged in a radial direction 13 next to the receptacle 32 for the sintered part 1. The rolling tools 28 are arranged such that they can rotate with respect to the sintered part 1 and the punches 9 and are able to rotate together around the sintered part 1 in the peripheral direction 19. For this purpose, the rolling tools 28 are arranged in a rotatable first tool part 34 which is mounted rotatably with respect to a stationary second tool part 35 via bearings (not illustrated here).

Each rolling tool 28 comprises a roller 37, which is guided at least or exclusively in a peripheral direction 19 along the peripheral surface 31 of the sintered part 1. The second compressive force 27 is applied to the sintered part 1 via the roller 37. The roller 37 rolls on the sintered part 1 in the process. The outer peripheral surface of the roller 37 of the rolling tool 28 has a specific shape, with the result that this specific shape is transferred to the sintered part 1 via the rolling tool 28 in the course of the rolling operation. The roller 37 has a shoulder 38 which also supports the sintered part 1 or the end 10 of the sintered part 1 and the third end face 24 with respect to the axial direction 4, 6.

The sintered part 1 has a first end face 5, a second end face 7 spaced apart in an axial direction 4, 6, and a peripheral face 31 between the end faces 5, 7.

The tool 25 comprises a control unit 33 suitably designed (equipped, configured or programmed) to control the tool 25 for carrying out the method, with the control unit 33 being able to control the punch 9 and the mandrel 47, and therefore the first compressive force 26, and additionally the rolling tools 28 and the first tool part 34, and therefore the second compressive force 27, at least intermittently at the same time.

LIST OF REFERENCE SIGNS

1 Sintered part
2 Green compact
3 Base
4 First axial direction
5 First end face
6 Second axial direction
7 Second end face
8 Press
9 Punch
10 End
11 First height
12 Elevation
13 Radial direction
14 First width
15 First density
16 Second height
17 Second width
18 Side surface
19 Peripheral direction
20 Cross section
21 First region
22 Second region
23 Third region
24 Third end face
25 Tool
26 First compressive force
27 Second compressive force
28 Rolling tool
29 Slide
30 Device
31 Peripheral surface
32 Receptacle
33 Control unit
34 First tool part
35 Second tool part
36 Roller carrier
37 Roller
38 Shoulder
39 Field line
40 Housing
41 Coil
42 Body
43 Lowest density
44 Highest density
45 Axis
46 Die
47 Mandrel
48 Spring

The invention claimed is:

1. A method for producing a calibrated sintered part, wherein the method comprises at least the following steps:

a) providing a sintered part, wherein the sintered part has at least one base with a first end face facing in a first axial direction and a second end face facing in a second axial direction and also an elevation extending over a first height from the first end face to one end at least in the axial direction, wherein the elevation has a first width extending in a radial direction and transversely to the axial direction that is at least partially less than 0.8 millimeters, wherein, along the first width, the sintered part at least partially has a first density which is at least 85% of a full density of the material, wherein the elevation forms a third end face at the end;

b) arranging the sintered part in a tool;

c) using the tool to subject the sintered part to a first compressive force acting on the end faces at least in the axial direction;

d) subjecting the sintered part to a second compressive force acting at least on part of the elevation at least in a radial direction, wherein the sintered part is shaped at least by the second compressive force, wherein steps c) and d) are carried out at least partially at the same time and the sintered part is a calibrated sintered part after steps c) and d).

2. The method as claimed in claim 1, wherein the first density along the first width is at least partially at least 92% of the full density of the material.

3. The method as claimed in claim 1, wherein the first width is at least partially less than 0.3 millimeters.

4. The method as claimed in claim 1, wherein the elevation has a second height which extends in the axial direction between the second end face and the end of the elevation, wherein, in the axial direction between the first end face and the end, the elevation has a maximum second width extending in the radial direction, wherein the second width is at most 1.0 millimeter, wherein the first height is at least 5% of the second height.

5. The method as claimed in claim 1, wherein at least one side surface of the elevation runs at least partially inclined at an angle of at most 30 angular degrees with respect to the axial direction.

6. The method as claimed in claim 1, wherein the elevation extends in a peripheral direction, extending transversely to the axial direction, along the first end face in the form of a ring or a segment of a ring.

7. The method as claimed in claim 1, wherein at least the elevation has multiple regions with differing densities in a cross section.

8. The method as claimed in claim 1, wherein the end is processed exclusively by shaping at least after the sintering, wherein the sintered part has the third end face which extends parallel to the radial direction.

9. The method as claimed in claim 1, wherein at least the elevation comprises a magnetic material.

10. The method as claimed in claim 1, wherein the sintered part is also at least partially shaped by the first compressive force.

11. The method as claimed in claim 1, wherein the first compressive force is applied to the sintered part at least over the entire first end face, the entire second end face and the entire third end face.

12. The method as claimed in claim 1, wherein the second compressive force is applied to the sintered part via at least one rolling tool or via a slide that is moveable at least in the radial direction.

13. The method as claimed in claim 1, wherein the sintered part is pressed quasi-isostatically by the first compressive force and the second compressive force.

* * * * *